US006142440A

United States Patent [19]

Gratz et al.

[11] Patent Number: 6,142,440

[45] Date of Patent: Nov. 7, 2000

[54] LARGE ROLL SUPPORT HAVING REINFORCEMENT BRIDGES

[75] Inventors: Jeffrey J. Gratz, Hartland; Robert W. Swannell, Neenah; Robb A. Warren, Appleton, all of Wis.

[73] Assignee: Great Northern Corporation, Appleton, Wis.

[21] Appl. No.: 09/276,419

[22] Filed: Mar. 25, 1999

[51] Int. Cl.[7] ..... A47B 91/00

[52] U.S. Cl. ..... 248/346.01; 206/564; 206/443; 108/55.3; 108/57.29; 108/51.11

[58] Field of Search ..... 248/346.01; 206/814, 206/390, 820, 391, 394, 443, 564; 229/406, 407; 108/55.3, 57.29, 51.11

[56] References Cited

U.S. PATENT DOCUMENTS

| | | | |
|---|---|---|---|
| 4,606,496 | 8/1986 | Marx et al. | 229/2.5 R |
| 4,832,196 | 5/1989 | Butler | 206/391 |
| 5,899,331 | 5/1999 | Warren, Jr. | 206/443 |
| 5,934,467 | 8/1999 | Gilfert et al. | 206/391 |

OTHER PUBLICATIONS

Great Northern Model 11S Fiber Roll Supports, admitted prior art.

*Primary Examiner*—Ramon O. Ramirez
*Assistant Examiner*—A. Joseph Wujciak, III
*Attorney, Agent, or Firm*—Andrus, Sceales, Starke & Sawall, LLP

[57] ABSTRACT

An improved roll support for stabilizing and storing large rolls of web material. The roll support is preferably an elongated molded pulp member. A roll of web material is generally supported by a roll supporting surface defined by a plurality of support wedges contained on a face side surface of the roll support. Each of the support wedges are spaced apart by generally rectangular depressions formed in the front face surface. A plurality of enlarged sidewall arches are formed in the sidewalls of the roll support. The roll support includes a reinforcement bridge formed on the back side surface between each sidewall arch and a protrusion on the back side of the large roll support which corresponds to one of the rectangular depressions on the face side of the large roll support. Preferably, a reinforcement bridge is formed from each corner of the protrusion to one of the sidewall arches. The reinforcement bridges increase the structural stability of the roll support under heavy loads, and prevent the sidewalls from deforming during the forming process. The outer peripheral support surface of the roll support preferably includes enlarged arch feet that increase the surface area of the peripheral support surface which also increases the structural stability of the roll support. In another embodiment, the roll support structure is not elongated, and contains only two pairs of support wedges. In this embodiment, more than one roll support structure is normally used to stabilize and support large rolls.

22 Claims, 3 Drawing Sheets

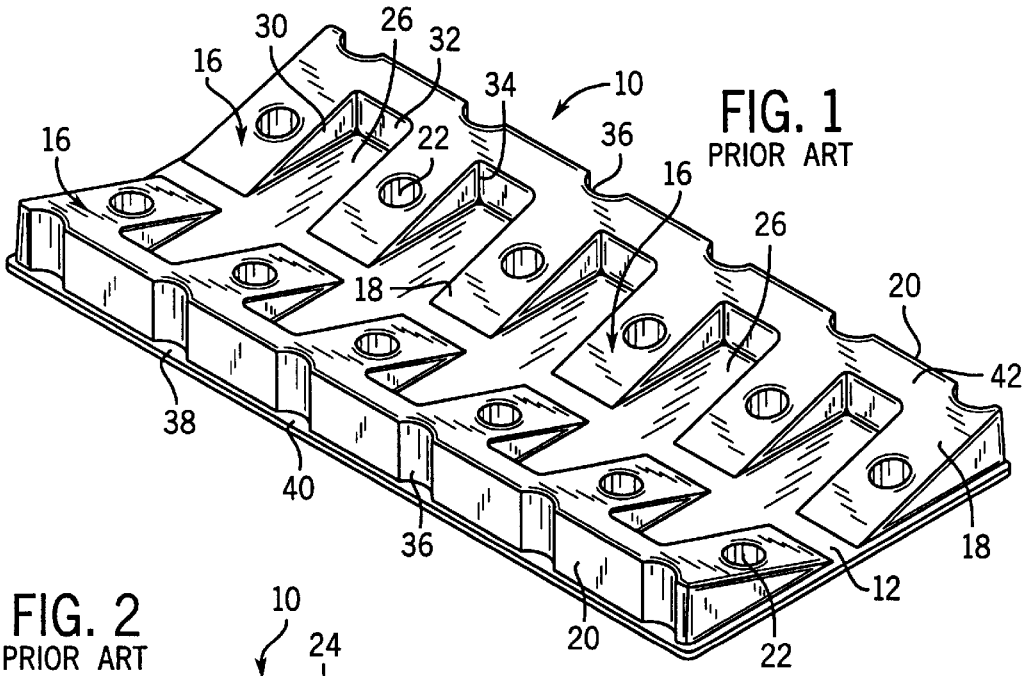
FIG. 1
PRIOR ART
FIG. 2
PRIOR ART
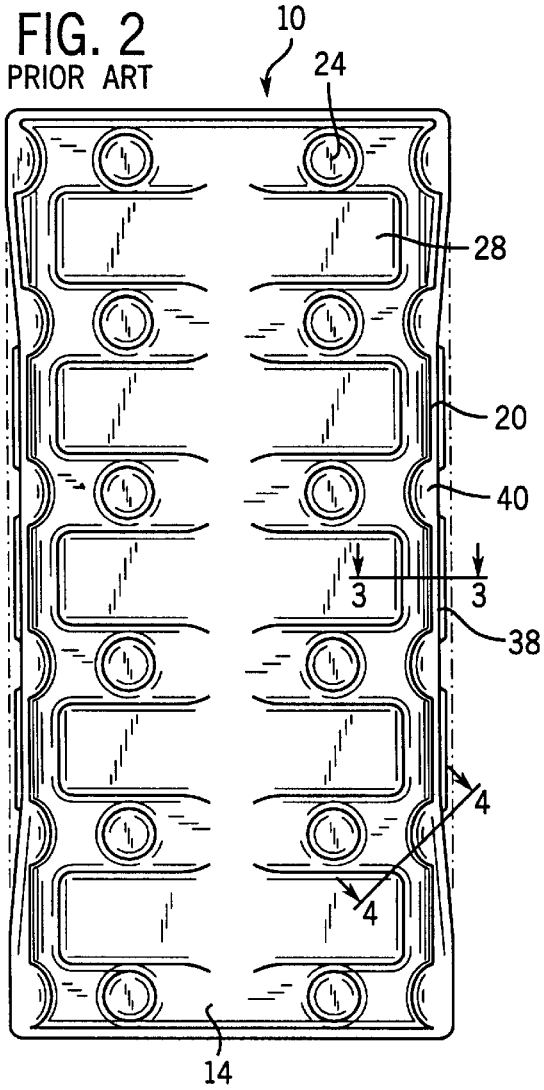
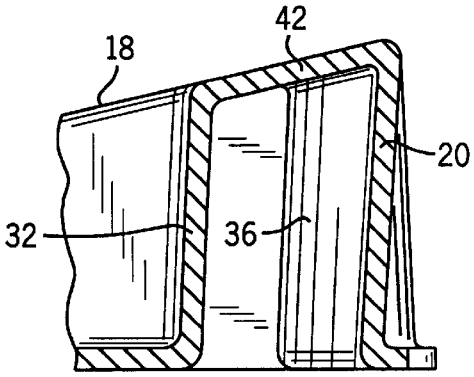
FIG. 3
PRIOR ART
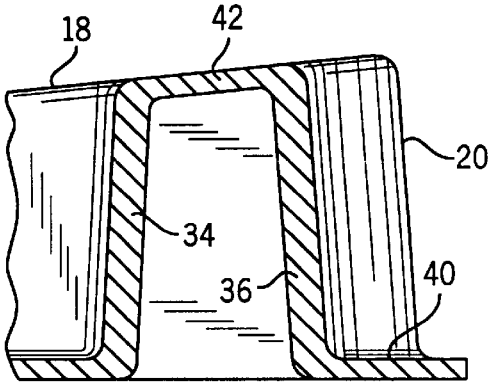
FIG. 4
PRIOR ART

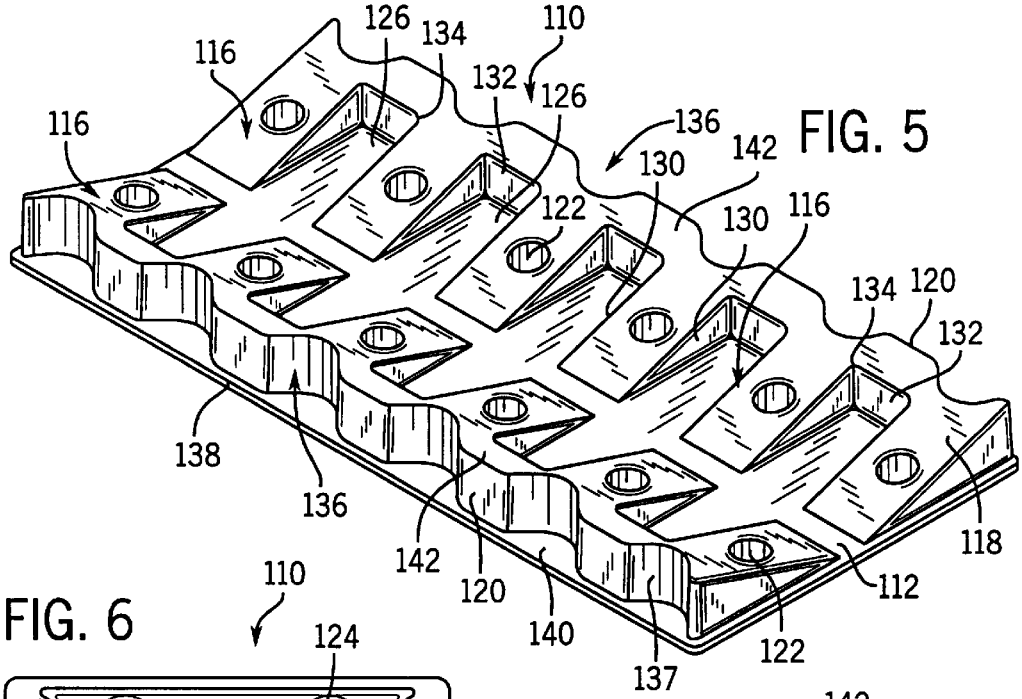
FIG. 5
FIG. 6
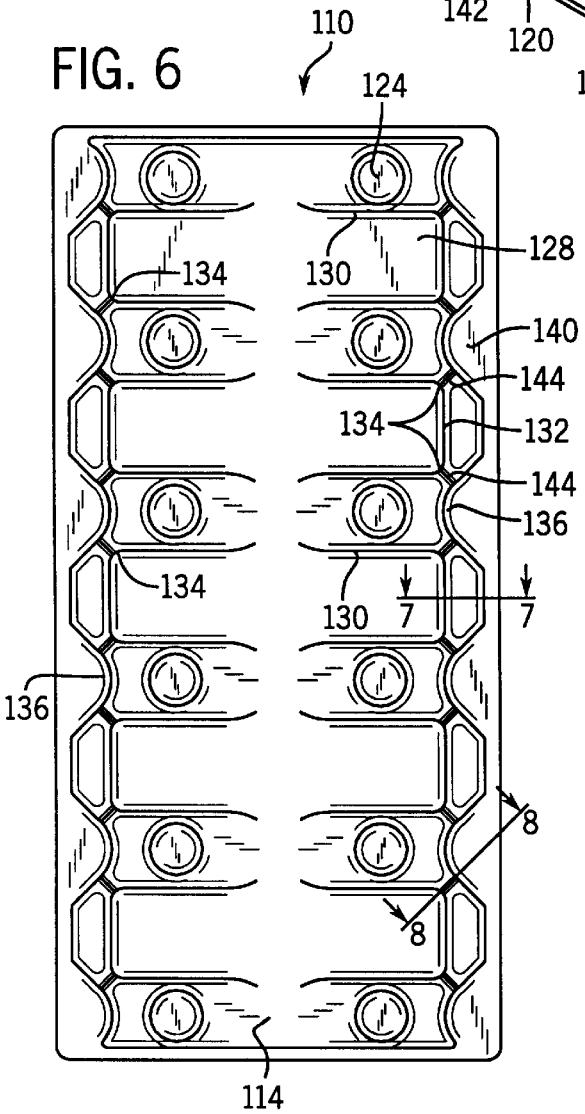
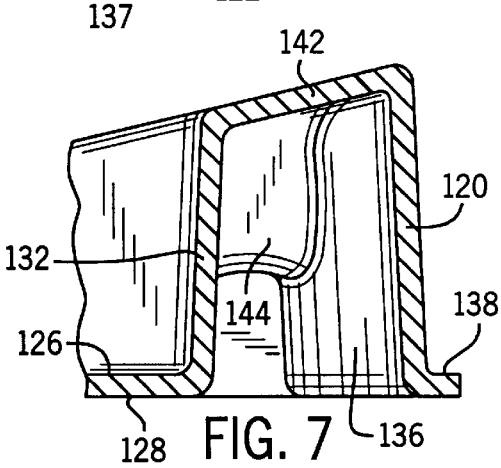
FIG. 7
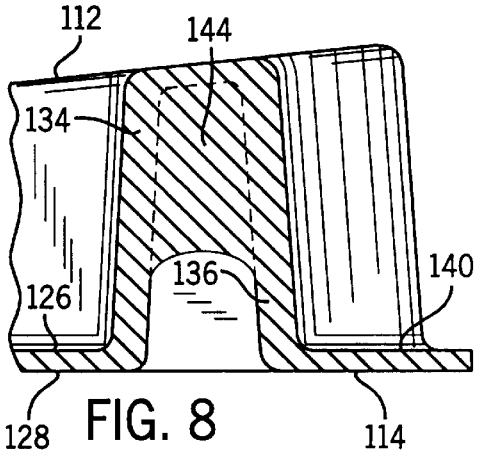
FIG. 8

LARGE ROLL SUPPORT HAVING REINFORCEMENT BRIDGES

BACKGROUND OF THE INVENTION

The present invention relates to the stabilizing and packaging of large rolls of web material for shipping and/or storage. Specifically, the present invention is an improved large roll support preferably made from molded pulp for supporting a roll of web material and preventing the roll of web material from shifting or moving.

Large rolls of web material, such as those having outer diameters of 24" to 40" or greater, must be supported and prevented from moving during extended periods of storage or during shipment of the rolls of web material. One method of supporting a large roll of material is to insert wedges between the roll of web material and the ground to prevent the roll from shifting during shipment and/or storage. While simple wedges are effective to prevent the roll of web material from shifting, individual wedges can damage the outer layers of the web material by either depressing the outer layers of the web material or introducing small tears into the web material. Such problems are particularly evident in the storage and/or shipment of relatively delicate materials such as polyethylene films or other similar products.

In order to alleviate the foregoing problems, the applicant has attempted to develop various types of large roll supports with varying degrees of success. The applicant has typically tested large roll supports formed from molded pulp. These large roll supports includes spaced support wedges separated by recessed portions. The support wedges formed on the roll support define a roll support surface that contacts the outer circumferential surface of the large roll of web material.

It is important that the roll supports have sufficient strength to prevent crushing and collapse of the roll support under the weight of large rolls of web material. It is also important that the rolls supports have sufficient flexibility to permit limited deformation for appropriate cushioning and to allow accommodation of rolls of material having varying diameters.

Heretofore, applicant's molded pulp roll supports included small arches formed in their sidewalls to increase the structural strength of the sidewall in an attempt to prevent collapse of the roll support. Additionally, recesses were formed in the roll supporting surface of the spaced support wedges. The combination of the sidewall arches and recesses are important to provide the molded roll support with the delicate balance between strength and flexibility necessary for adequate cushioning of large heavy rolls. The sidewall arches and recesses also tend to facilitate stability during the pulp molding process.

Heretofore, recesses in the spaced support wedges and ridges in the sidewall of molded pulp roll supports have been deemed necessary by applicant. As mentioned, one advantage of the recesses and the sidewall arches is to increase the strength of the roll support surface to prevent the roll support from collapsing under the weight of large rolls of web material. Nonetheless, applicant's prior molded pulp roll supports often suffered from structural problems which lead to collapse of the sidewall when supporting large, heavy rolls of web material. Failure of applicant's prior large roll supports were normally characterized by an inward deflection of the sidewall.

SUMMARY OF THE INVENTION

The invention is a molded large roll support that includes one or more spaced, support wedges to support a roll of web material. The roll support is preferably fabricated from dried molded pulp. In order to maintain sufficient strength of the roll support sidewalls and to prevent the inward deflection of the roll support sidewalls during fabrication, the support sidewalls of the roll support include enlarged sidewall arches. Preferably, the sidewall arches are positioned such that at least one reinforcement bridge is formed between each sidewall arch and one of the protrusions formed on the back side surface of the roll support between the spaced, support wedges. The reinforcement bridges provide additional reinforcement for the roll support sidewalls such that heavy loads do not cause the roll supports to collapse during usage. In addition, the reinforcement bridges help to prevent inward deflection of the sidewall during molding, which also helps to strengthen the sidewall in use.

The preferred roll support includes a plurality of spaced support wedges that are formed on the face side surface of the roll support in two opposing rows. Each of the support wedges inclines upward as it extends from the middle portion of the roll support to one of the roll support sidewalls. The inclined or sloped roll support surface of the support wedges contacts the roll of web material when the roll is placed on the roll support. Preferably, each of the support wedges includes a flexural cushioning recess formed in the roll support surface that helps the roll support surface properly support, flex and cushion the roll of web material during use.

The support wedges are spaced from each other along the face side surface of the roll support by a plurality of depressions. The depressions formed on the face side surface create corresponding protrusions that extend from the back side surface of the roll support. The reinforcement bridges are formed between these protrusions and the respective sidewall arch. In the preferred roll support, each of the depressions is generally rectangular and is defined by a pair of depression sidewalls and an endwall that intersect at a pair of depression corners. Correspondingly, each of the protrusions formed on the back side surface of the roll support is also generally rectangular and includes the pair of depression corners. When the roll support is initially molded, the reinforcement bridges are formed on the back side surface of the roll support between each of the sidewall arches and at least one of the protrusions on the back side surface. In the preferred structure, having rectangular depressions between the spaced support wedges, the reinforcement bridges extend between the corners of the rectangular protrusions and the respective sidewall arch. As mentioned, the reinforcement bridges strengthen the support sidewalls and prevent the roll support sidewalls from inclining inward during the fabrication process.

In accordance with another aspect of the invention, a plurality of enlarged arch feet are formed in the outer peripheral support surface of the roll support. Preferably, the enlarged arch feet are each generally aligned with the support wedges formed on the face side surface of the roll support to provide additional stability for the support sidewall when a roll of web material is placed on the roll support of the invention. The dimensions of the enlarged arch feet contained on the peripheral support surface are generally defined by the enlarged sidewall arches. Preferably, the sidewall arches extend inward from the roll support sidewall at least ⅔ of the distance between the roll support sidewall and the depression endwall.

As should be apparent to those skilled in the art, the invention provides an improved large roll support that has sufficient strength to prevent crushing and collapse of the roll support sidewall, while being flexible enough to properly cushion and allow use on rolls having varying outer diameters. The overall design allows for proper support and cushioning for a wide range of roll diameters without requiring modification of roll support dimensions. In this regard, the invention provides a practical technique to render molded large roll supports (e.g. molded pulp large roll supports) sufficiently strong and flexible for practical commercial use.

Other features and advantages may be apparent to those skilled in the art upon reviewing the following drawings and the description thereof.

BRIEF DESCRIPTION OF THE DRAWINGS

Prior Art

FIG. 1 is a perspective view of a molded pulp large roll support in accordance with the prior art having small radiused sidewall arches;

FIG. 2 is a bottom plan view of the large roll support shown in FIG. 1 illustrating inward inclination of the support sidewalls;

FIG. 3 is a partial section view taken along line 3—3 in FIG. 2 illustrating the inward inclination of the support sidewall of the prior art large roll support; and FIG. 4 is a partial section view taken along line 4—4 illustrating the spacing between one of the sidewall arches and a corner of a protrusion on the back side of the large roll support which corresponds to one of the rectangular depressions between the support wedges on the face side of the large roll support.

Present Invention

Figure 10:
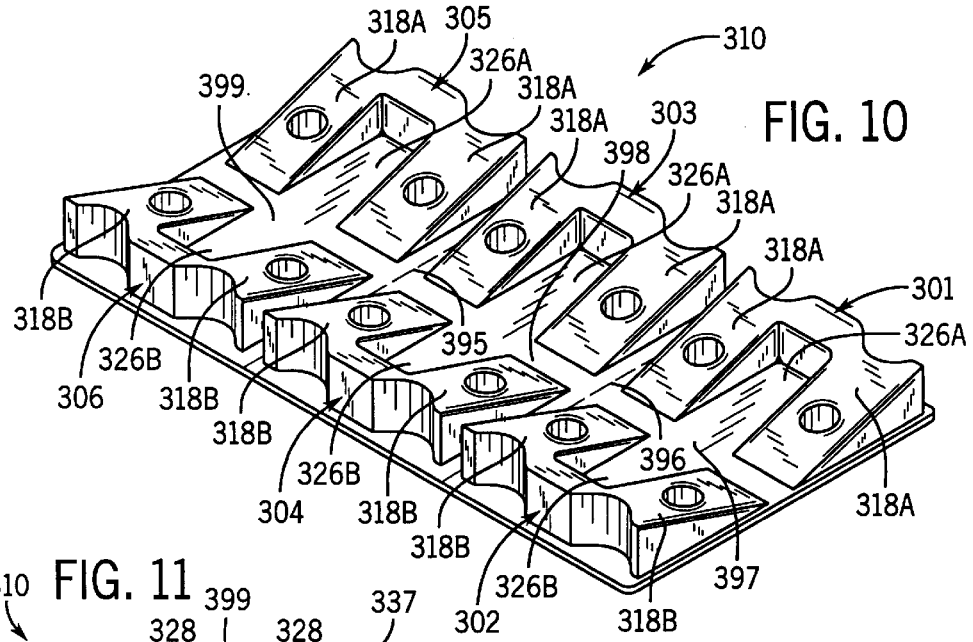
Figure 11:
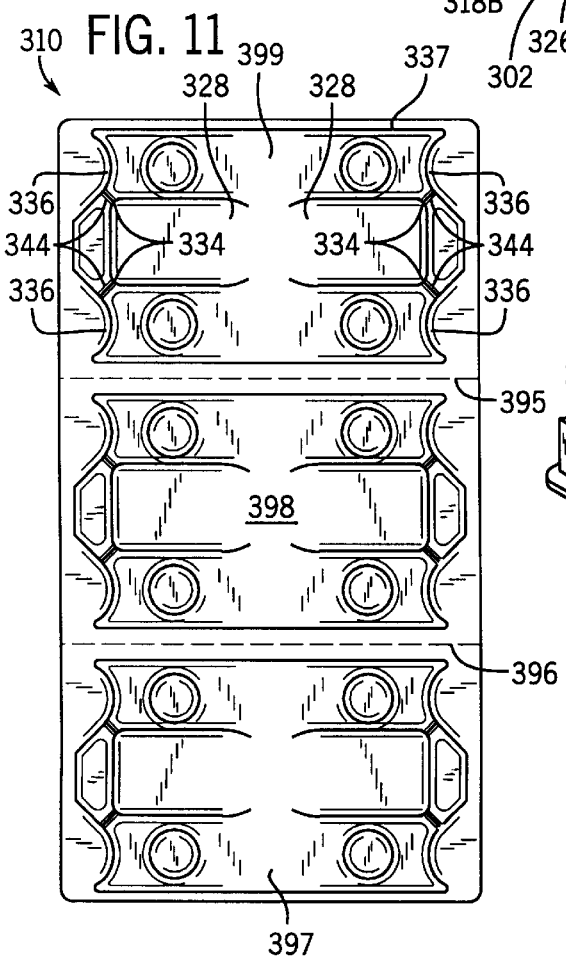
Figure 9:
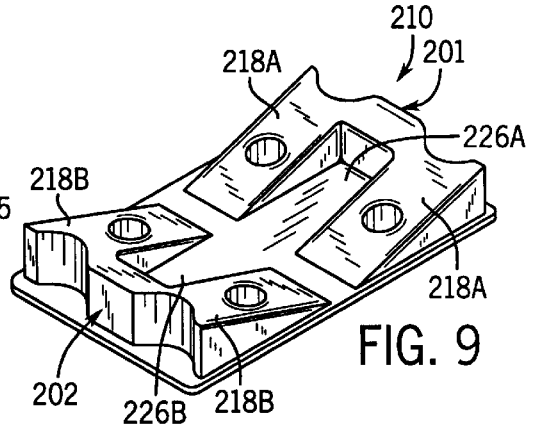

FIG. 5 is a perspective view of a molded pulp large roll support which includes reinforcement bridges and enlarged sidewall arches in accordance with the invention;

FIG. 6 is a bottom plan view of the back side surface of the large roll support shown in FIG. 5 illustrating the reinforcement bridges;

FIG. 7 is a partial section view taken along line 7—7 in FIG. 6 illustrating the reinforcement bridge formed between one of the sidewall arches and a corner of a protrusion on the back side of the larger roll support which corresponds to one of the rectangular depressions between the support wedges on the face side of the large roll support;

FIG. 8 is a partial section view taken along line 8—8 in FIG. 6 further illustrating a reinforcement bridge formed between one of the sidewall arches and a corner of a protrusion on the back side of the large roll support which corresponds to one of the rectangular depressions between the support wedges on the face side of the large roll support;

FIG. 9 is a perspective view of a molded pulp large roll support in accordance with another embodiment of the invention in which each side of the roll support contains only two support wedges;

FIG. 10 is a perspective view of a molded pulp large roll support in accordance with yet another embodiment of the invention in which three versions of the roll support shown in FIG. 9 are molded integrally together with a perforation therebetween; and FIG. 11 is a bottom plan view of the embodiment of the large roll support shown in FIG. 10.

DETAILED DESCRIPTION OF THE INVENTION

Prior Art

A molded pulp large roll support 10 in accordance with the prior art is shown in FIGS. 1–4. The roll support 10 includes a molded face side surface 12 and a felted back side surface 14. The face side surface 12 includes a plurality of spaced support wedges 16. Each support wedge 16 includes a roll supporting surface 18 that inclines from the middle portion of the roll support 10 upward to one of the respective sidewalls 20 of the roll support 10. The roll supporting surface 18 on each of the support wedges 16 contacts the outer circumference of a roll of web material (not shown) when the roll is supported by the roll support 10. The support wedges 16 on the roll support 10 prevent the roll of web material from moving and/or shifting when being stored or shipped.

Each of the support wedges 16 preferably includes a flexural cushioning recess 22 which helps to facilitate the proper combination of strength and flexibility so that the roll support 10 provides adequate cushioning for large, heavy rolls of web material. The shape and flexing of the roll supporting surface 18 allows the roll support 10 to accommodate rolls of web material having large variations (e.g., 24" to 40") in their outer diameters without damaging the outer layers of the web material. As can be seen in FIG. 2, each of the flexural cushioning recesses 22 formed in the face side surface 12 creates a corresponding rounded protrusion 24 on the back side surface 14.

The support wedges 16 are spaced by a plurality of rectangular depressions 26 formed in the face side surface 12 of the roll support 10. Each of the depressions 26 in the face side surface 12 forms a corresponding protrusion 28 on the back side surface 14 of the roll support 10. The depressions 26 are defined by an outer peripheral wall consisting of a pair of depression sidewalls 30 and a depression endwall 32. The depression sidewalls 30 and the depression endwall 32 intersect at a pair of depression corners 34.

The roll support sidewalls 20 provide the structural support for each support wedge 16 to prevent the support wedges 16 from collapsing under the weight of a heavy roll of web material. To increase the strength of each roll support sidewall 20, a plurality of sidewall arches 36 are formed in each of the support sidewalls 20. Each of the sidewall arches 36 extend inward from the otherwise generally planar support sidewall 20. A peripheral support surface 38 is formed around the entire exterior of the roll support 10 and provides a relatively flat surface that stabilizes the roll support 10 on the ground. The peripheral support surface 38 includes a plurality of arch feet 40 that provide additional stability for the roll support 10. Each of the arch feet 40 is an expanded portion of the peripheral support surface 38. The dimensions of the arch feet 40 are generally defined by the amount the sidewall arch 36 extends inward from the support sidewall 20.

As can be seen in FIGS. 3 and 4, the depression/protrusion endwall 32 is spaced from the support sidewall 20. A longitudinal roll support surface 42 spans across the space between the depression endwall 32 and the support sidewall 20. Additionally, as can be seen in FIG. 4, the depression corner 34 is also spaced from the sidewall arch 36. In this prior art structure, each of the sidewall arches 36 extends inwardly from the support sidewall 20 approximately ⅓ of the width of the longitudinal roll support surface 42.

The prior art molded pulp roll support 10 shown in FIGS. 1–4 is formed by submerging a porous mold in a pulp mixture (e.g. a water and fiber slurry such as, but not limited to, corrugated and newspaper blends, etc.) and applying a vacuum to the mold. The mold is then removed from the slurry. The wet pulp structure is then placed on a screen, and dried and cured. During the forming process, the support sidewalls 20 oftentimes deflect inward and dry in the deformed position shown best in FIGS. 2 and 3. The phantom line in FIG. 2 illustrates the desired, generally vertical position for each of the support sidewalls 20 of the roll support 10 as compared to the actual, inwardly inclined or inwardly deflected position. The inward deflection of each roll support sidewall 20 increases the likelihood that the roll support 10, and specifically the support wedges 16, will collapse under the weight of a heavy roll of web material. The propensity of the roll support sidewalls 20 to deflect inward as shown in FIGS. 2 and 3 is one of the primary drawbacks of the prior art molded pulp roll support 10, especially when the roll support 10 is used with heavy loads and/or large diameter rolls.

Present Invention

FIGS. 5 and 6 illustrate a roll support 110 in accordance with the invention, which is useful for supporting a large roll of web material to prevent the roll of web material from shifting or moving during storage and/or shipment of the roll. The roll support 110 generally includes a face side surface 112 and a back side surface 114. If the roll support 110 is made from molded pulp, as in the preferred embodiment, the face side surface 112 is a molded surface and the back side surface 114 is a felted surface.

The roll support 110 includes a plurality of spaced support wedges 116 formed on the face side surface 112. The support wedges 116 each include a roll supporting surface 118 that contacts the outer circumference of the roll of web material supported by the roll support 110. Each of the support wedges 116 inclines from the middle portion of the roll support 110 to a respective support sidewall 120. The support sidewalls 120 are generally parallel walls spaced by the width of the roll support 110. The support sidewalls 120 provide the structural strength to prevent the roll support 110 from collapsing under the weight of a large diameter roll of web material.

Each of the support wedges 116 includes a generally semi-spherical flexural cushioning recess 122 formed in the roll supporting surface 118. Each of the flexural cushioning recesses 122 forms a corresponding semi-spherical rounded protrusion 124 on the back side surface 114 of the roll support 110, as shown in FIG. 6. The flexural cushioning recess 122 formed in the support wedge 116 helps to facilitate the proper combination of strength and flexibility so that the roll support 10 provides adequate cushioning and support for large, heavy rolls of web material. The combination of the shape and flexing of the roll support 110 allows accommodation of rolls having large variations in their outer diameters without damaging the outer layers of the web material. For example, the roll support 110 is designed to support rolls generally having outer diameters ranging between 24" and 40".

The support wedges 116 formed on the face side surface 112 are spaced from each other by a plurality of depressions 126. The depressions 126 formed in the face side surface 112 create corresponding protrusions 128 on the back side surface 114, as shown in FIG. 6. In the preferred embodiment of the invention, the depressions 126 and protrusions 128 are generally rectangular and are defined by an outer peripheral wall comprised of a pair of depression/protrusion sidewalls 130 and a depression/protrusion endwall 132. The depression/protrusion sidewalls 130 intersect with the depression/protrusion endwall 132 to define a pair of depression corners 134. The depression sidewalls 130, depression endwall 132 and depression/protrusion corners 134 also define the corresponding protrusion 128 extending from in the back side surface 114, as shown in FIG. 6. In the preferred embodiment of the invention, the depression/protrusion endwall 132 has a height of approximately 2".

As mentioned, the roll support 110 is preferably fabricated from molded pulp. To fabricate the roll support 110, it has been found that a pulp mixture containing 60% corrugated and 40% newspaper normally has sufficient strength and flexibility, although other mixtures are likely to be suitable depending on the particular molding process. In many applications, it is preferred that the pulp mixture includes recycled paper cups or the like and thus includes a bleached white recycled fiber and wax component. It has been found that the addition of wax to the pulp mixture increases the strength and flexibility of the molded pulp when dried, as well as increases resistance to humidity and moisture. Preferably, a vacuum is drawn on a submerged porous mold so that the molded pulp roll support 110 typically has a thickness of about ⅛ to ⅜ of an inch. The wet molded pulp roll support is then dried and cured.

The support sidewalls 120 provide the required structural stability to prevent the roll support 110 from collapsing under the weight of a large roll of web material. In order to strengthen each of the sidewalls 120, a plurality of enlarged sidewall arches 136 are formed in each of the support sidewalls 120. Each of the sidewall arches 136 is defined by an arcuate wall 137 that is spaced inwardly from the otherwise generally planar support sidewall 120. As can best be seen in FIG. 5, each of the sidewall arches 136 is generally aligned with one of the support wedges 116, such that the sidewall arches 136 increase the structural strength of the support sidewall 120 at the specific location where the roll support 110 carries the greatest amount of weight. As can be seen by comparing the prior art roll support 10 shown in FIG. 1 to the roll support 110 of the present invention, the enlarged sidewall arches 136 in roll support 110 extend inward significantly farther from the support sidewall 120 as compared to the prior art sidewall arches 36 in roll support 10.

As can be seen in FIG. 5, a peripheral support surface 138 extends around the entire roll support 110 to create a relatively flat surface upon which the roll support 110 rests. The peripheral support surface 138 includes a plurality of enlarged arch feet 140 that increase the amount of surface area contact between the roll support 110 and the ground. The dimensions of the enlarged arch feet 140 are generally defined by the indentation of the sidewall arch 136 from the support sidewall 120. Each of the enlarged arch feet 140 increase the stability of the roll support 110.

As can best be understood in FIGS. 5 and 7, a longitudinal roll supporting surface 142 is formed between the support sidewall 120 and the depression/protrusion endwall 132. The longitudinal roll supporting surface 142 contacts the outer circumference of the roll of web material to help stabilize the roll. The expanded sidewall arches 136 extend into and remove a portion of the longitudinal roll supporting surface 142.

Each of the enlarged sidewall arches 136 formed in the support sidewalls 120 extend inwardly from the respective support sidewall 120 a sufficient distance such that a reinforcement bridge 144 is formed between each sidewall arch 136 and at least one of the protrusions 128 formed in the back side surface 114. As previously discussed, each of the protrusions 128 formed along the back side surface 114 corresponds to one of the rectangular depressions 126 formed on the front side surface 112 between the support wedges 116.

In the preferred embodiment of the invention, the reinforcement bridges 144 are formed diagonally between each corner 134 and the sidewall arch 136 positioned diagonally therefrom. Thus, a pair of the reinforcement bridges 144 are joined to each of the sidewall arches 136. As can best be seen in FIG. 8, each reinforcement bridge 144 extends vertically from the molded, face side surface 112 and partially fills the gap between the corner 134 of the protrusion 128 and the sidewall arch 136.

An important consideration when forming the roll support 110 including the reinforcement bridges 144 is the size of each sidewall arch 136 formed in the support sidewalls 120. The sidewall arches 136 need to extend inwardly from the respective support sidewall 120 a distance sufficient such that the sidewall arches 136 approach the corners 134 of the protrusions 128 formed on the back side surface 114. In the preferred embodiment of the invention, the sidewall arches 136 extend inwardly from the respective support sidewall 120 at least ⅔ of the width of the longitudinal roll supporting surface 142, which is the distance between the support sidewall 120 and the depression/protrusion endwalls 132. With the sidewall arches 136 appropriately sized and positioned, reinforcement bridges 144 will form between the protrusions 128 and the sidewall arches 136 during the mold pulp vacuum forming process.

The reinforcement bridges 144 perform several functions that improve the roll support 110 compared to the prior art roll support 10 shown in FIG. 1. The reinforcement bridges 144 provide increased support for each of the support sidewalls 120 of the roll support 110 during the molding process. As the roll support 110 is removed from the porous mold, the reinforcement bridges 144 prevent the support sidewalls 120 from collapsing inward as was the case with the support sidewalls 20 of the prior art roll support 10 shown in FIG. 3. The additional molded material of the reinforcement bridges 144 stabilizes the support sidewalls 120 in a generally vertical position as shown in FIG. 7 during the molding process.

Additionally, the reinforcement bridges 144 increase the amount of molded material existing between each of the protrusions 128 and the sidewall arches 136 after the rolls support 110 is dried. This increased amount of molded material strengthens each of the support sidewalls 120, which helps prevent the roll support 110 from collapsing under a heavy load.

Also as previously discussed, the enlarged sidewall arches 136 are aligned with the respective support wedges 116 which also aids in preventing the support wedges 116 and support sidewalls 120 from collapsing under load.

FIG. 9 illustrates a roll support 210 in accordance with another embodiment of the invention in which the roll support 210 in FIG. 9 is not elongated like the roll support 110 shown in FIG. 5. In practice, it is typical to use more than one of the truncated roll supports 210 to stabilize and support large rolls (for example, it is typical to use two or three of the truncated roll supports 210). The roll support 210 shown in FIG. 9 contains only two pairs 201, 202 of support wedges 218*a*, 218*b*. A first depression 226 is positioned between the support wedges 218*a* of the first pair 201 of support wedges. A second depression 226*b* is positioned between the support wedges 218*b* of the second pair 202 of support wedges. In other respects, the roll support 210 is similar to the roll support 110 shown in FIG. 5.

FIG. 10 shows a roll support structure 310 having three units 397, 398, 399 each similar in structure to the truncated roll support 210 shown in FIG. 9. In roll support 310 shown in FIG. 10, units 397, 398, 399 are integrally molded and are separated by molded perforations 395 and 396, respectively. In other words, the first pair 301 of support wedges 318*a* is separated from the third pair 303 of support wedges 318*a* by perforation 396. Likewise, the second pair 302 of support wedges 318*b* is separated from the fourth pair 304 of support wedges 318*b* by perforation 396. The third pair 303 of support wedges 318*a* is separated from the fifth pair of support wedges 318*a* by perforation 395. The fourth pair 304 of support wedges 318*b* is separated from the sixth pair 306 of support wedges 318*b* by perforation 395.

Referring to FIG. 11, which is a plan view of the back side of the roll support 310 shown in FIG. 10, reinforcement bridges 344 are formed between each sidewall arch 336 and the adjacent protrusion 328. More specifically, the reinforcement bridges 344 are formed between the sidewall arches 336 and the corner 334 of the adjacent protrusion 328. Note that no special reinforcement bridges are formed between the sidewall arches 336 and the adjacent end wall 337. Additional structural support is not needed at that point in the structure 310. The roll support structure 310 shown in FIGS. 10 and 11 can be used in a manner similar to roll support 110 shown in FIG. 5, or the units 397, 398, 399 can be separated along the perforations 396 and 395 to use in a manner similar to the roll support 210 shown in FIG. 9.

The preferred embodiment of the invention has been disclosed herein, however, the scope of the invention is not limited to these disclosed preferred embodiments. Rather, the following claims are to be interpreted to include variations and modifications which do not substantially depart from the true spirit of the invention as claimed below.

We claim:

1. A structure for supporting a roll of web material, the structure comprising:

a formed member having a face side surface, an opposed back side surface, a pair of opposed support sidewalls and a longitudinal middle portion positioned at a location between the opposed support sidewalls and extending longitudinally along the formed member;

a plurality of spaced support wedges formed on the face side surface of the formed member, each support wedge extending from the middle portion to one of the support sidewalls and inclining upward as the support wedge extends from the middle portion to the respective sidewall, wherein the support wedges define roll supporting surfaces for contacting an outer circumference of a roll of web material placed longitudinally on the formed member;

a plurality of spaced depressions formed in the face side surface of the formed member, each depression positioned between a pair of the support wedges;

a plurality of spaced sidewall arches formed in the support sidewalls of the formed member; and a plurality of reinforcement bridges formed on the back side surface of the formed member, wherein at least one of the reinforcement bridges is formed between one of the sidewall arches and a protrusion on the back side surface corresponding to one of the depressions formed in the front side surface.

2. The structure of claim 1 wherein the spaced sidewall arches are each generally aligned with one of the support wedges.

3. The structure of claim 1 wherein each of the protrusions formed in the back side surface of the formed member is generally rectangular and defined by a pair of protrusion sidewalls and a protrusion endwall, the protrusion sidewalls and protrusion endwall intersecting to form a pair of protrusion corners.

4. The structure of claim 3 wherein reinforcement bridges formed between a respective sidewall arch and a respective protrusion extend between the respective sidewall arch and the protrusion corner of the respective protrusion.

5. The structure of claim 1 wherein the formed member is constructed from dried molded pulp, and the face side surface is a molded surface and the back side surface is a felted surface.

6. The structure of claim 5 wherein the molded pulp includes bleached white fiber wax.

7. The structure of claim 1 wherein each of the sidewall arches extends inwardly from one of the support sidewalls at least ⅔ of the distance between the support sidewall and a depression endwall.

8. The structure of claim 1 further comprising a peripheral support surface extending around the formed member and joined to each support sidewall of the formed member, the peripheral surface including a plurality of enlarged arch feet each aligned with one of the sidewall arches.

9. A structure for supporting a roll of web material, the structure comprising:

a formed member having a face side surface, an opposed back side surface, a pair of opposed support sidewalls and a longitudinal middle portion positioned at a location between the opposed support sidewalls and extending longitudinally along the formed member;

a plurality of spaced support wedges formed on the face side surface of the formed member, each support wedge extending from the middle portion to one of the support sidewalls and inclining upward as the support wedge extends from the middle portion to the respective sidewall, wherein the support wedges define roll supporting surfaces for contacting an outer circumference of a roll of web material placed longitudinally on the formed member;

a plurality of spaced depressions formed in the face side surface of the formed member, each depression positioned between a pair of the support wedges;

a plurality of spaced sidewall arches formed in the sidewalls of the formed member; and a peripheral support surface surrounding the formed member and joined to each of the formed member support sidewalls, the peripheral support surface including a plurality of enlarged arch feet each aligned with one of the sidewall arches, the enlarged arch feet providing support for the formed member when the formed member is used to support a roll of web material;

wherein each of the depressions formed in the face side surface is defined by a pair of depression sidewalls and a depression endwall, the depression endwall being generally perpendicular to and spaced from one of the support sidewalls of the formed member by a longitudinal roll supporting surface;

wherein each of the sidewall arches extends inwardly from the formed member support sidewall at least ⅔ of the width of the longitudinal roll supporting surface formed between the formed member support sidewall and the depression endwall.

10. The structure of claim 9 wherein each of the spaced sidewall arches are generally aligned with one of the support wedges, such that each of the enlarged arch feet are generally aligned with one of the support wedges.

11. The structure of claim 9 wherein the formed member is constructed from dried molded pulp, and the face side surface is a molded surface and the back side surface is a felted surface.

12. The structure of claim 11 wherein the molded pulp includes bleached white fiber and wax.

13. The structure of claim 9 wherein each of the enlarged arch feet help prevent the inclination of the formed member support sidewalls during molding of the formed member.

14. A structure for supporting a roll of web material, the structure comprising:

a formed member having a face side surface, an opposed back side surface and a pair of opposed support sidewalls;

at least two pairs of spaced support wedges formed on the face side surface of the formed member, a first pair of support wedges extending from one of the support sidewalls and a second pair of support wedges extending from the opposing support sidewall;

a first depression formed in the face side surface of the formed member between the support wedges of the first pair of support wedges;

a second depression formed in the face side surface of the formed member between the support wedges of the second pair of support wedges;

a plurality of spaced sidewall arches formed in the support sidewalls of the formed member; and a plurality of reinforcement bridges formed on the back side surface of the formed member, wherein at least one of the reinforcement bridges is formed between one of the sidewall arches and a protrusion on the back side surface corresponding to one of the depressions formed in the front side surface.

15. The structure of claim 14 wherein the spaced sidewall arches are each generally aligned with one of the support wedges.

16. The structure of claim 14 wherein each of the protrusions formed in the back side surface of the formed member is generally rectangular and defined by a pair of protrusion sidewalls and a protrusion endwall, the protrusion sidewalls and protrusion endwall intersecting to form a pair of protrusion corners.

17. The structure of claim 16 wherein reinforcement bridges formed between a respective sidewall arch and a respective protrusion extend between the respective sidewall arch and the protrusion corner of the respective protrusion.

18. The structure of claim 14 wherein the formed member is constructed from dried molded pulp, and the face side surface is a molded surface and the back side surface is a felted surface.

19. The structure of claim 14 further comprising:

a third pair of support wedges extending from one of the support sidewalls;

a fourth pair of support wedges extending from the opposing support sidewall;

a third depression formed in the face side surface of the formed member between the support wedges of the third pair of support wedges;

a fourth depression formed in the face side surface of the formed member between the support wedges of the fourth pair of support wedges; and perforation means extending across the formed member and separating the first pair of support wedges from the third pair of support wedges and the second pair of support wedges from the fourth pair of support wedges.

20. The structure of claim 14 wherein the formed member is constructed from dried molded pulp which includes a bleached white fiber and wax.

21. The structure of claim 14 wherein the sidewall arches extend inwardly from one of the support sidewalls at least ⅔ of the distance between the support sidewall and a depression endwall.

22. The structure of claim 14 further comprising a peripheral support surface extending around the formed member and joined to each support sidewall of the formed member, the peripheral surface including a plurality of enlarged arch feet each aligned with one of the sidewall arches.

* * * * *